US007870966B2

(12) United States Patent
Swanson

(10) Patent No.: US 7,870,966 B2
(45) Date of Patent: Jan. 18, 2011

(54) MODULAR RACK

(75) Inventor: Craig A. Swanson, Canyon Lake, TX (US)

(73) Assignee: Taprite-Fassco Mfg., Inc., San Antonio, TX (US)

( * ) Notice: Subject to any disclaimer, the term of this patent is extended or adjusted under 35 U.S.C. 154(b) by 572 days.

(21) Appl. No.: 11/211,859

(22) Filed: Aug. 25, 2005

(65) Prior Publication Data

US 2006/0266726 A1 Nov. 30, 2006

Related U.S. Application Data

(60) Provisional application No. 60/685,463, filed on May 27, 2005.

(51) Int. Cl.
*A47B 43/00* (2006.01)

(52) U.S. Cl. ..... 211/194

(58) Field of Classification Search ..... 211/194, 211/188, 186, 128.1, 85.4, 90.01, 187
See application file for complete search history.

(56) References Cited

U.S. PATENT DOCUMENTS

| | | | | |
|---|---|---|---|---|
| 2,400,807 | A | 5/1946 | Burkhard | |
| 2,988,315 | A | 6/1961 | Saxe | |
| 3,487,951 | A * | 1/1970 | Beltzung | 211/133.2 |
| 3,602,159 | A | 8/1971 | Marschak | |
| 3,879,068 | A | 4/1975 | Stampfli | |
| 3,888,353 | A | 6/1975 | Leifheit | |
| 4,247,133 | A | 1/1981 | Moller | |
| 4,426,008 | A * | 1/1984 | Olson et al. | 211/59.2 |
| 4,441,684 | A | 4/1984 | Credle, Jr. | |
| 5,016,765 | A * | 5/1991 | Leonardo | 211/189 |
| D320,521 | S | 10/1991 | Baur | |
| 5,379,976 | A | 1/1995 | DeGirolamo | |
| D357,923 | S | 5/1995 | Peterson et al. | |
| 5,492,455 | A | 2/1996 | Durham et al. | |
| 5,624,167 | A | 4/1997 | Katz | |
| D388,439 | S | 12/1997 | Cantley et al. | |
| 6,050,662 | A | 4/2000 | Filipek et al. | |
| 6,123,208 | A | 9/2000 | Haenszel | |
| 6,161,708 | A | 12/2000 | Myler | |
| D438,741 | S | 3/2001 | Murphy | |
| 6,241,106 | B1 | 6/2001 | Fujita et al. | |
| 6,267,268 | B1 | 7/2001 | Quartarone et al. | |
| D446,414 | S | 8/2001 | Schafer | |

(Continued)

FOREIGN PATENT DOCUMENTS

| | | |
|---|---|---|
| WO | WO 87/07236 | 3/1987 |

OTHER PUBLICATIONS

U.S. Appl. No. 29/284,907, filed Sep. 18, 2007, Swanson.

(Continued)

*Primary Examiner*—Sarah Purol
(74) *Attorney, Agent, or Firm*—Greenberg Traurig, LLP

(57) ABSTRACT

Disclosed herein is a modular rack for attachment of a sliding mount bracket thereto. The modular rack includes one or more modular shelves, wherein each one of the modular shelves is of an inclined type or a level type. The modular rack preferably includes at least one end panel having louvers formed therein for receiving the sliding mount bracket. Each one of the louvers includes a slat, an aperture corresponding therewith, and a receiving area positioned therebetween.

45 Claims, 8 Drawing Sheets

U.S. PATENT DOCUMENTS

| | | | | |
|---|---|---|---|---|
| D446,968 | S | 8/2001 | Spencer | |
| 6,435,357 | B1 * | 8/2002 | Lee | 211/70.6 |
| 6,530,486 | B1 | 3/2003 | Batting et al. | |
| 6,834,768 | B2 * | 12/2004 | Jersey et al. | 211/189 |
| D512,254 | S | 12/2005 | Ottens | |
| D556,546 | S | 12/2007 | Swanson et al. | |
| 2002/0117462 | A1 | 8/2002 | Hung | |
| 2004/0245200 | A1 | 12/2004 | Jersey et al. | |
| 2005/0006329 | A1 * | 1/2005 | Williquette | 211/113 |

OTHER PUBLICATIONS

U.S. Appl. No. 11/856,948, filed Sep. 18, 2007, Swanson, et al.
Taprite-Fassco, Bag-in-Box Rack Catalog Sheets (Jan. 1998) (4 pages).

* cited by examiner

MODULAR RACK

CROSS-REFERENCE TO RELATED APPLICATIONS

The present application claims the benefit of U.S. Provisional Application No. 60/685,463 filed May 27 2005, which is hereby incorporated by reference in its entirety for all purposes.

FIELD OF THE INVENTION

The present invention relates generally to racks for storing bag-in-box containers, and, more particularly, to such racks having a modular design and integrated pump mounting means.

BACKGROUND OF THE INVENTION

It is known in the art to use bag-in-box (BIB) containers for the storage of syrup, juice concentrate, and other liquids. BIB containers are generally box-shaped and have a bag positioned therein for containing the liquid. A restaurateur (or any other person) can use a BIB container in connection with a pump and one or more canisters of soda water, for example, to form a carbonated beverage and to convey the carbonated beverage to a dispenser.

It is also known in the art to have multi-shelf racks for storing BIB containers. Such racks typically use "level" shelving (e.g., shelves that are substantially parallel with the ground) and "inclined" shelving (e.g., shelves that are substantially angled with respect to the ground). A restaurateur ordinarily makes the choice between level and inclined shelving depending on the requests of the manufacturer of the syrup. For example, one major cola manufacturer requests that restaurateurs store their BIB containers on level shelving, while another major cola manufacturer requests that restaurateurs store their BIB containers on inclined shelving.

It is also known in the art to use modular racks for the storage of BIB containers. For example, FIG. 1 shows a prior art shelf that may be stacked upon other prior art shelves of the same type. However, the prior art shelf shown in FIG. 1 is not formed from a plurality of modular components secured to one another. In this regard, the prior art shelf may not be easily broken-down. Furthermore, while it is typically desirable to secure one or more pumps to a modular rack, the prior art shelf shown in FIG. 1 requires separate hardware to install brackets for mounting pumps thereto.

What is needed in the art is a modular rack that facilitates easy disassembly and transport thereof and that further facilitates the easy mounting of a pump thereto.

SUMMARY OF THE INVENTION

The present invention overcomes the disadvantages and shortcomings of the prior art discussed above by providing a modular rack for attachment thereto of a sliding mount bracket securable to a peripheral device, such as a pump, canister, etc. The modular rack includes one or more modular shelves, wherein at least one of the modular shelves includes a plurality of subassemblies and a plurality of intra-shelf connectors each securing one of the subassemblies to another one of the subassemblies adjacent thereto. At least one of the subassemblies preferably includes an end panel having louvers formed therein for receiving the sliding mount bracket.

In accordance with a first exemplary embodiment of the invention, the modular rack includes at least one modular shelf having a left end subassembly, a right end subassembly, and a middle subassembly, each of which includes a front frame member aligned along a front axis and a rear frame member aligned along a rear axis. The modular shelf includes a plurality of intra-shelf connectors securing the frame members of the middle subassembly to the frame members of the right subassembly and the left subassembly corresponding therewith. The modular shelf further includes a plurality of support members securing the rear frame member of the middle subassembly to the front frame member of the middle subassembly, such as to support a BIB container positioned thereon.

In the first exemplary embodiment of the invention, the front axis has a lower elevation than the rear axis. In this regard, a BIB container may be positioned on the support members at an angle with respect to ground-level. In the first exemplary embodiment of the invention, the modular frame includes stopping means to prevent the BIB container from moving downwardly.

Each of the left and right end subassemblies preferably includes mounting means for securing one or more peripheral devices thereto. The mounting means preferably includes louvers formed in the respective end panels thereof. Each louver comprises a slat formed from a metal sheet of the end panel corresponding herewith and further comprises an aperture corresponding thereto. The louvers are sized and positioned to receive sliding mount bracket that is attachable to a peripheral device, such as a pump, a canister, etc. In some embodiments of the invention, the louvers are not required. The left-end subassembly and/or the right-end subassembly can include other mounting means, such as brackets installed on the end panels, or no mounting means.

The modular rack may further include an additional modular shelf and a plurality of inter-shelf connectors securing the modular shelf atop the additional modular shelf. The right end subassembly and the left end subassembly of the additional modular shelf each have front and rear leg members having female connection ends. The inter-shelf connectors mate with the female connection ends of the front and rear leg members of the modular shelf and the additional modular shelf to secure corresponding leg members in axial alignment with one another. In some embodiments of the invention, the modular rack comprises more than two modular shelves. The modular shelf and the additional modular shelf are preferably interchangeable (e.g., the inter-shelf connectors can secure the additional modular shelf atop the modular shelf).

The modular rack may further comprise a peripheral device support subassembly and another plurality of said inter-shelf connectors for securing the peripheral device support subassembly to a modular shelf positioned below (or above) the peripheral device support subassembly. The peripheral device support subassembly includes one or more rear end panels. The peripheral device support subassembly includes mounting means for securing a peripheral device, such as pump or a canister, thereto. The mounting means preferably includes louvers formed in the rear end panel. Each louver comprises an aperture and a slat formed from a metal sheet of the rear end panel corresponding therewith, and the louvers are sized and positioned to receive a sliding mount bracket. In some embodiments of the invention, the louvers are not required, and the peripheral device support subassembly includes other mounting means, such as slots and/or brackets, or no mounting means.

In accordance with a second exemplary embodiment of the invention, the modular rack includes at least one modular shelf having a left end subassembly, a right end subassembly, and a middle subassembly, each of which includes a front frame member aligned along a front axis and a rear frame member aligned along a rear axis. The elevation of the front axis and the elevation of the rear axis are about equal. The modular shelf further includes a plurality of support members securing the rear frame member of the middle subassembly to the front frame member of the middle subassembly, whereby a BIB container positioned thereon can be leveled.

It shall be understood that the relative terminology used herein, such as "front", "rear", "middle" "top", "bottom" "side", "inside", "outside", "left", "right", "horizontal", "vertical", etc., is solely for the purposes of clarity and designation and does not limit the scope of the present invention to structural embodiments having a certain position with respect to the environments thereof.

BRIEF DESCRIPTION OF THE DRAWINGS

For a more complete understanding of the present invention, reference is made to the following detailed description of various exemplary embodiments considered in conjunction with the accompanying drawings, in which.

DETAILED DESCRIPTION OF THE EXEMPLARY EMBODIMENTS

Figure 1:
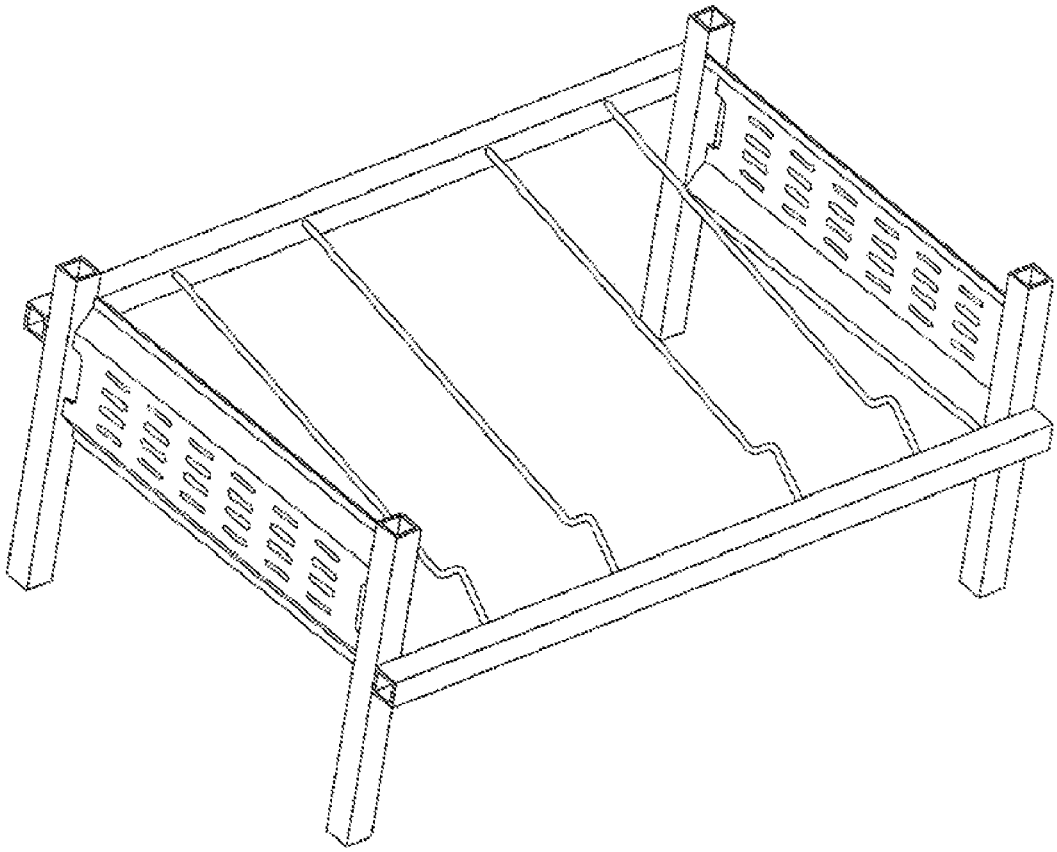
FIG. 1 (Prior Art)
FIG. 1 is a perspective view showing a prior art rack.
Figure 2:
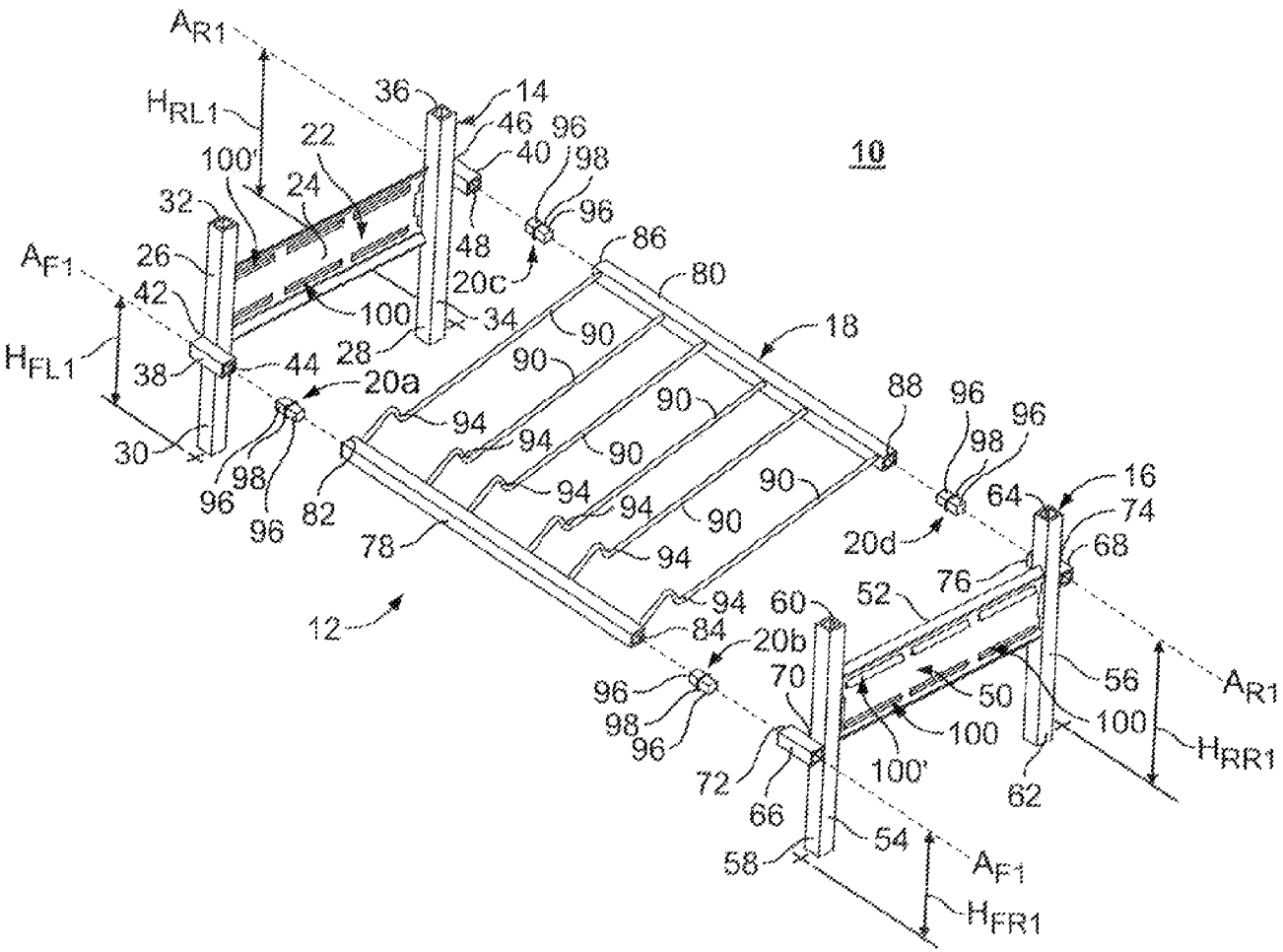
FIG. 2 is a horizontally-exploded perspective view showing a modular rack constructed in accordance with a first exemplary embodiment of the present invention, the modular rack shown including a single shelf of an inclined type.

Referring to FIG. 2, an exemplary modular rack 10 constructed in accordance with a first exemplary embodiment of the present invention is shown to include a single modular shelf 12. A BIB container (shown in FIG. 8) may be seated on the modular shelf 12 at an angle with respect to ground level, and the modular shelf 12 is therefore referenced herein as being of an inclined type. The modular shelf 12 includes a left end subassembly 14, a right end subassembly 16, at least one middle subassembly 18, and a plurality of intra-shelf connectors 20*a-d* that secure the middle subassembly 18 to the left end subassembly 14 and the right end subassembly 16.

The left end subassembly 14 includes a left end panel 22 that has an inside surface, referenced herein as a left inside surface 24. The left end subassembly 14 also includes a front left leg member 26 and a rear left leg member 28 that are each preferably cut from square, steel tubing. The front left leg member 26 is welded to the left end panel 22, extends vertically therefrom, and has a hollow bottom end, referenced herein as a front left base end 30, and a hollow top end, referenced herein as a front left top end 32. The rear left leg member 28 is welded to the left end panel 22, extends vertically therefrom, and has a hollow bottom end, referenced herein as a rear left base end 34, and a hollow top end, referenced herein as a rear left top end 36.

The left end subassembly 14 further includes a front left frame member 38 and a rear left frame member 40 that are each preferably cut from square, steel tubing. The front left frame member 38 is welded to the front left leg member 26 to form a front left juncture point 42. The front left frame member 38 extends perpendicularly therefrom along a front axis $A_{F1}$ and terminates at an end referenced herein as a front left female connection end 44. The rear left frame member 40 is welded to the rear left leg member 28 to form a rear left juncture point 46. The rear left frame member 40 extends perpendicularly therefrom along a rear axis $A_{R1}$ and terminates at an end referenced herein as a rear left female connection end 48.

As discussed above, the modular shelf 12 of FIG. 2 is of an inclined type for supporting BIB containers at an angle with respect to ground-level. In this regard, the distance between the front left base end 30 and the front left juncture point 42, referenced herein as distance $H_{FL1}$, is less than the distance between the rear left base end 34 and the rear left juncture point 46, which is referenced herein as distance $H_{RL1}$. Thus, in the modular shelf 12 of the inclined type, the front left frame member 38 is closer to ground-level than the rear frame member 40.

Continuing with reference to FIG. 2, the right end subassembly 16 includes a right end panel 50 that has an inside surface, referenced herein as a right inside surface 52. The right end subassembly 16 includes a front right leg member 54 and a rear right leg member 56 that are each preferably cut from square, steel tubing. The front right leg member 54 is welded to the right end panel 50, extends vertically therefrom, and has a hollow bottom end, referenced herein as a front right base end 58, and a hollow top end, referenced herein as a front right top end 60. The rear right leg member 56 is welded to the right end panel 50, extends vertically therefrom, and has a hollow bottom end, referenced herein as a rear right base end 62, and a hollow top end, referenced herein as a rear right top end 64.

The right end subassembly 16 further includes a front right frame member 66 and a rear right frame member 68 that are each preferably cut from square, steel tubing. The front right framer member 66 is welded to the front right leg member 54 to form a front right juncture point 70. The front right frame member 66 extends perpendicularly therefrom along the front axis $A_{F1}$ and terminates at an end referenced herein as a front right female connection end 72. The rear right frame member 68 is welded to the rear right leg member 56 to form a rear right juncture point 74. The rear right frame member 68 extends perpendicularly therefrom along the rear axis $A_{R1}$ and terminates at an end referenced herein as a rear right female connection end 76.

The distance between the front right base end 58 and the front right juncture point 70, referenced herein as distance $H_{FR1}$, is substantially equal to the distance $H_{FL1}$. The distance between the rear right base end 62 and the rear right juncture point 74, referenced herein as distance $H_{RR1}$, is substantially equal to the distance $H_{RL1}$. The distance $H_{FR1}$ is less than the distance $H_{RR1}$, such that the front axis $A_{F1}$ has a lower elevation than the rear axis $A_{R1}$.

Continuing with reference to FIG. 2, the middle subassembly 18 includes a front middle frame member 78 and a rear middle frame member 80 that are each preferably cut from square, steel tubing. The front middle frame member 78 extends along the front axis $A_{F1}$ and terminates at a plurality of ends, which are herein referenced in the plural as front middle female connection ends 82, 84. The rear middle frame member 80 extends along the rear axis $A_{R1}$ and terminates at a plurality of ends, which are herein referenced in the plural as rear middle female connection ends 86, 88. As discussed above, the modular shelf 12 of FIG. 2 is of an inclined type, and the distance $H_{FR1}$ is less than the distance $H_{RR1}$. In this regard, the front frame members 38, 66, 78 have a lower elevation than the rear frame members 40, 68, 80.

Figure 8:
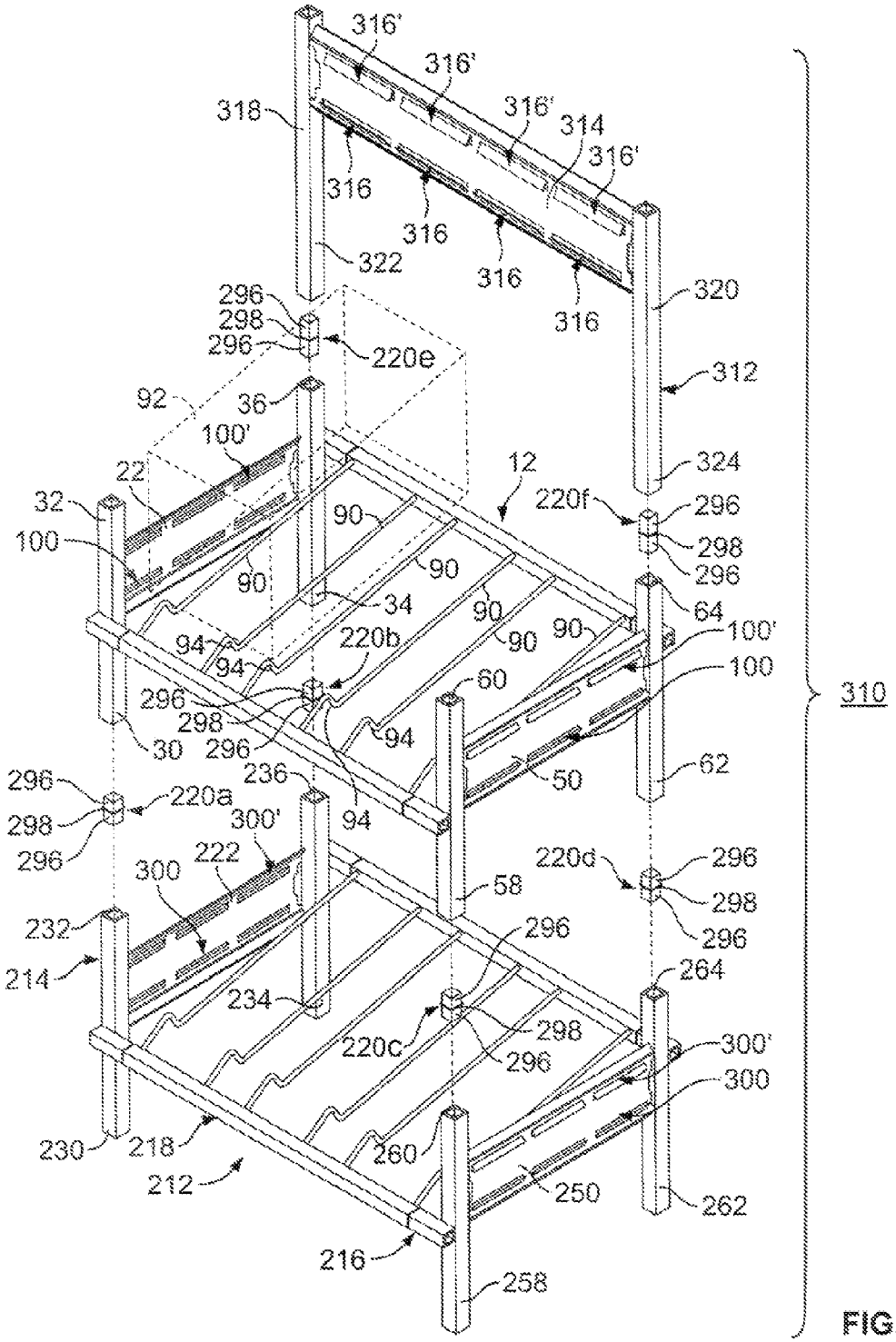
FIG. 8 is a vertically-exploded perspective view showing the modular shelf of FIG. 2 in combination with a peripheral device support subassembly.

The middle subassembly 18 further includes a plurality of support members 90, preferably formed from steel, that secure the front middle frame member 78 to the rear middle frame member 80 and that extend perpendicularly with respect to the front middle frame member 78 and the rear middle frame member 80. Because the front middle frame member 78 has a lower elevation than the rear middle frame member 80, the support members 90 slope downwardly from the rear middle frame member 80 to the front middle frame member 78. As shown in FIG. 8, at least one BIB container 92 may rest upon the support members 90, and the support members 90 have stopping means 94 formed therein to prevent the BIB container 92 from sliding forward. The stopping means 94 preferably includes a reverse-slope section formed in least one of the support members 90, however, other means shall be clear to one skilled in the art (e.g., stop plate, stop flange, etc.).

The intra-shelf connectors 20*a-d* secure the middle subassembly 18 to the left end subassembly 14 and the right end subassembly 16. Each one of the intra-shelf connectors 20*a-d* is preferably, though not necessarily, a dual-male connector having two male connection ends 96 and a center flange 98 positioned therebetween. The center flange 98 of each one of the intra-shelf connectors 20*a-d* has the same dimensions, such as top and bottom width and front and rear height, and appearance (e.g., color, etc.) of the frame members 38, 40, 66, 68, 78, 80, so as to blend with the surface appearance thereof. The length of each one of the intrashelf connectors 20*a-d* is about four inches (4"), and the length of each one of the male connection ends 96 is about two inches (2"). However, the scope of the invention is not limited to embodiments thereof constructed in accordance with said dimensions.

The male connection ends 96 and the female connection ends 44, 48, 72, 76, 82, 84, 86, 88 are preferably modular, such that each one of the male connection ends 96 is sized to securingly mate with any one of the female connection ends 44, 48, 72, 76, 82, 84, 86, 88. In this regard, each one of the female connection ends 44, 48, 72, 76, 82, 84, 86, 88 has an opening formed therein that is sized to receive and conceal one of the male connections ends 96. In the exemplary embodiment of the invention shown in FIG. 2, a first one of the male intrashelf connectors 20*a* secures the front left frame member 38 to the front middle frame member 78, a second one of the male intra-shelf connectors 20*b* secures the front right frame member 66 to the front middle frame member 78, a third one of the male intra-shelf connectors 20*c* secures the rear left frame member 40 to the rear middle frame member 80, and a fourth one of the male intra-shelf connectors 20*d* secures the rear right frame member 68 to the rear middle frame member 80.

Figure 3:
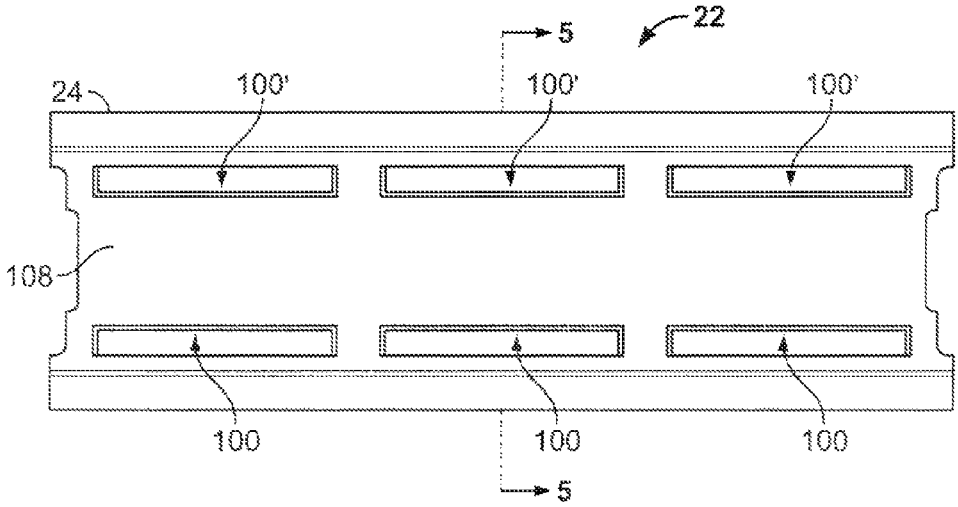
FIG. 3 is a left side view showing the left end panel of FIG. 2.
Figure 4:
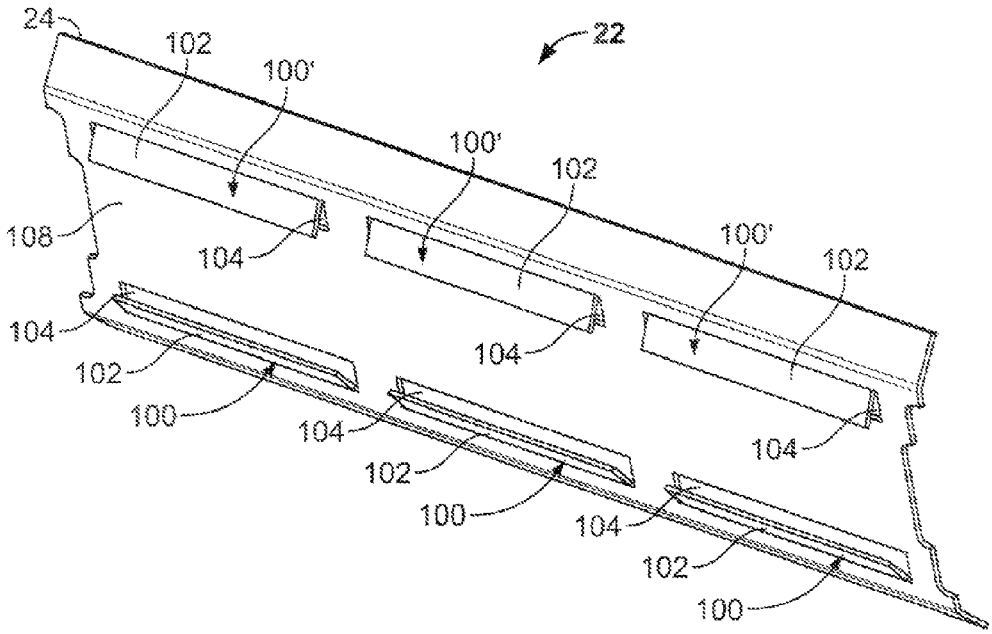
FIG. 4 is a perspective view showing the left end panel of FIGS. 2 and 3.
Figure 5:
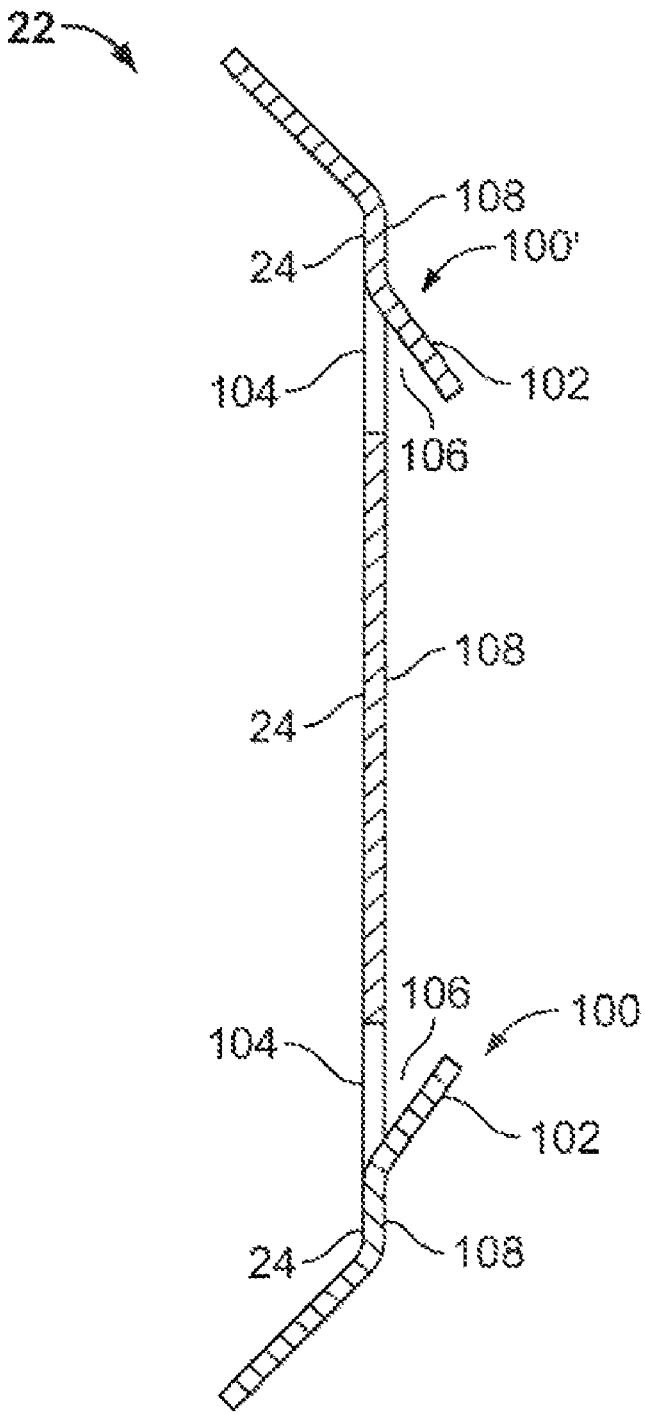
FIG. 5 is a cross-sectional view taken along section line 5-5 of FIG. 3.

With reference to FIGS. 3-5, the left end panel 22 of the modular shelf of FIG. 2 shall now be discussed with further detail, and it shall be understood that, in the exemplary embodiments of the invention, the right end panel 50 is a mirror image thereof.

The left end panel 22 has a plurality of louvers 100, 100' formed therein. The left end panel 22 is preferably formed from a metal sheet, and each one of the louvers 100, 100' is formed by punching or cutting the metal sheet. Each one of the louvers 100, 100' includes a slat 102, an aperture 104, and a receiving area 106 positioned therebetween. Each aperture 104 is formed in the left end panel 22 corresponding to where the metal sheet had been punched or cut, and the dimensions of each aperture 104 (e.g., length, width, thickness) are substantially equal to the dimensions of the slat 102 corresponding therewith. The left end panel 22 has an outside surface, referenced herein as a left outside surface 108, and each one of the louvers 100, 100' extends from the left outside surface 108, such that each receiving area 106 is easily accessible when a BIB container, such as the BIB container 92 shown in FIG. 8, is supported by the modular shelf 12.

Figure 6:
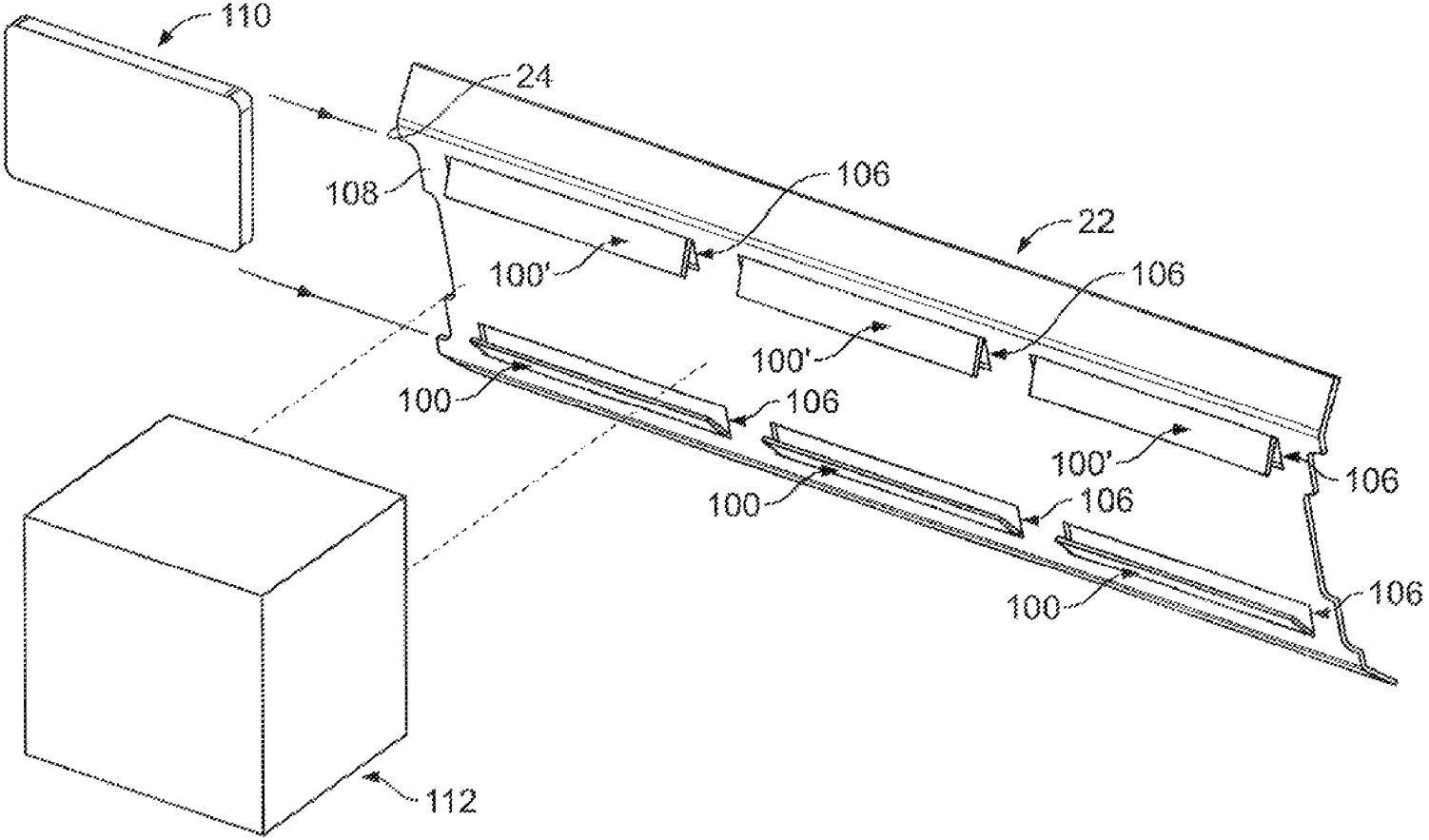
FIG. 6 is a partially exploded perspective view showing the left-end panel of FIGS. 2-5 with a schematic representation of a sliding mount bracket and a peripheral device.

Referring to FIG. 6, it is shown that each one of the louvers 100' is paired with one of the louvers 100, such that the receiving areas 106 of the pair thereof securingly receive a sliding mount bracket 110 adapted for attachment to a peripheral device 112 (e.g., a pump or canister). One of the louvers 100 in the pair opens in a first direction, such as upwardly, and the other one of the louvers 100' in the pair opens in a second direction opposite the first direction, such as downwardly. The sliding mount bracket 110 is attached to the peripheral device 112, and, in preferred embodiments of the invention, the modular shelf 12 does not require any additional hardware to secure the sliding mount bracket 110 to the left end panel 22. In FIG. 6, the sliding mount bracket 110 and the peripheral device 112 are depicted schematically, since the sliding mount bracket 110 may be adapted for attachment of any of the aforementioned peripheral devices 112.

Figure 7:
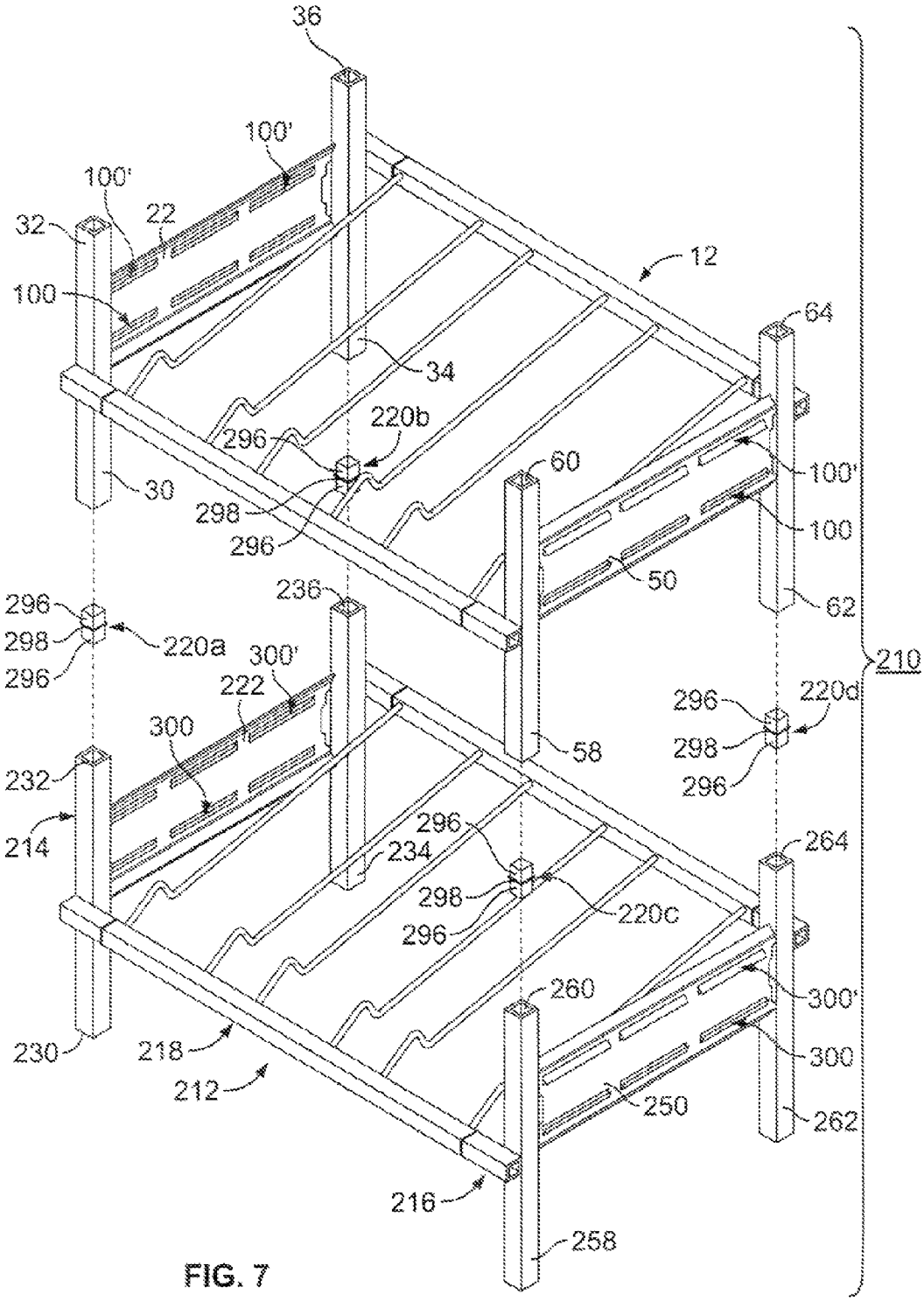
FIG. 7 is a vertically-exploded perspective view showing the modular shelf of FIG. 2 in combination with an additional modular shelf of the inclined type.

As shown in FIG. 7, a modular rack 210 may include more than one modular shelf. For example, the modular rack 210 may include the modular shelf 12 of FIG. 2 and another modular shelf, referenced herein as an additional modular shelf 212. The additional modular shelf 212 is preferably similar to the modular shelf 12 in all respects except those noted herein, and elements of the additional modular shelf 212 that correspond substantially to the elements of the modular shelf 12 described above have been designated by corresponding reference numerals being increased by two hundred. In this regard, the additional modular shelf 212 preferably includes a left end subassembly 214, a right end subassembly 216, and a middle subassembly 218 secured therebetween. The additional modular shelf 212 further includes leg members having hollow ends, including a front left base end 230, a front left top end 232, a rear left base end 234, a rear left top end 236, a front right base end 258, a front right top end 260, a rear right base end 262, and a rear right top end 264.

A plurality of inter-shelf connectors 220*a-f* is provided to secure the modular shelf 12 atop the additional modular shelf 212 when the modular shelf 12 is modularly stacked thereon (as shown in FIG. 7) and/or when the additional modular shelf 212 is stacked on the modular shelf 12 (not shown). The modular rack 210 may include any suitable number of shelves, modular shelves, or combinations thereof.

The inter-shelf connectors 220*a-f* are preferably similar to the intra-shelf connectors 20*a-d* and each one is preferably formed from plastic. The inter-shelf connectors 220*a-f* are preferably a dual-male connector having a center flange 298 and a plurality of male connection ends 296 extending from opposing sides of the center flange 298. The length of each one of the inter-shelf connectors 220*a-f* is about two inches (2"), and the length of each one of the male connection ends 296 thereof is about one inch (1"). However, the scope of the invention is not limited to embodiments of the invention constructed in accordance with such dimensions. Furthermore, it is not required that the inter-shelf connectors 220*a-f* and the intra-shelf connectors 20*a-d* be of the same connector type.

The inter-shelf connectors 220*a-f* secure the modular shelf 12 to the additional modular shelf 212. Each of the base ends 230, 234, 258, 262 and the top ends 232, 236, 260, 264 is modularly adapted to receive any one of the male connection ends 296 of any one of the inter-shelf connectors 220*a-f*. When the modular shelf 12 is stacked upon the additional modular shelf 212, a plurality of inter-shelf connectors 220 is used to secure the top ends 232, 236, 260, 264 of the additional modular shelf 212 to the base ends 30, 34, 58, 62 of the modular shelf 12. For example, as shown in FIG. 7, a first one of the inter-shelf connectors 220*a* secures the front left top end 232 of the additional modular shelf 212 to the front left base end 30 of the modular shelf 12, a second one of the inter-shelf connectors 220*b* secures the rear left top end 236 of the additional modular shelf 212 to the rear left base end 34 of the modular shelf 12, a third one of the inter-shelf connectors 220*c* secures the front right top end 260 of the additional modular shelf 212 to the front right base end 58 of the modular shelf 12, and a fourth one of the inter-shelf connectors 220*d* secures the rear right top end 264 of the additional modular shelf 212 to the rear right base end 62 of the modular shelf 12.

Referring to FIG. 8, a modular rack 310 can include a plurality of modular shelves, such as the modular shelf 12 and the additional modular shelf 212, as well as a peripheral device support subassembly 312. The peripheral device support subassembly 312 includes a rear end panel 314 having a plurality of louvers 316, 316' formed therein in similar respect to the louvers 100, 100' depicted in FIGS. 3-5. The louvers 316, 316' are adapted to receive the sliding mount bracket 110 of FIG. 6. The rear end panel 314 may, in some embodiments of the invention, be formed from the same sheet of metal used to form the left end panel 22 and/or the right end panel 50.

The peripheral device support subassembly 312 further includes a plurality of leg members, such as a peripheral support left leg member 318 and a peripheral support right leg member 320. The peripheral support left leg member 318 is preferably welded to the rear end panel 314, extends vertically therefrom, and terminates at a hollow end, referenced herein as a peripheral support left base end 322. The peripheral support right leg member 320 is preferably welded to the rear end panel 314, extends vertically therefrom, and terminates at a hollow end, referenced herein as a peripheral support right base end 324. The inter-shelf connectors 220 secure the peripheral device support subassembly 312 to the modular shelf 12. For example, a fifth one of the inter-shelf connectors 220*e* secures the peripheral support left base end 322 of the peripheral device support subassembly 312 to the rear left top end 36 of the modular shelf 12, while a sixth one of the inter-shelf connectors 220*f* secures the peripheral support right base end 324 of the peripheral device support subassembly 312 to the rear right top end 64 of the modular shelf 12. A peripheral device 112, such as, a pump (not shown) or a canister (not shown), may be secured to the modular rack 310 by attaching the sliding mount bracket 110 to such a peripheral device 112, for example, and then inserting the sliding count bracket 110 between the louvers 316, 316' of the rear end panel 314.

Preferred embodiments of the modular racks 10, 210, 310 are powder-coated. Furthermore, the modular racks 10, 210, 310 of the present invention are preferably adapted to support boxes and containers, such as the BIB container 92 shown in FIG. 8. In preferred embodiments of the invention, each modular shelf 12, 212 is adapted to support two to three BIB containers 92. However, the scope of the invention is not so limited.

Figure 9:
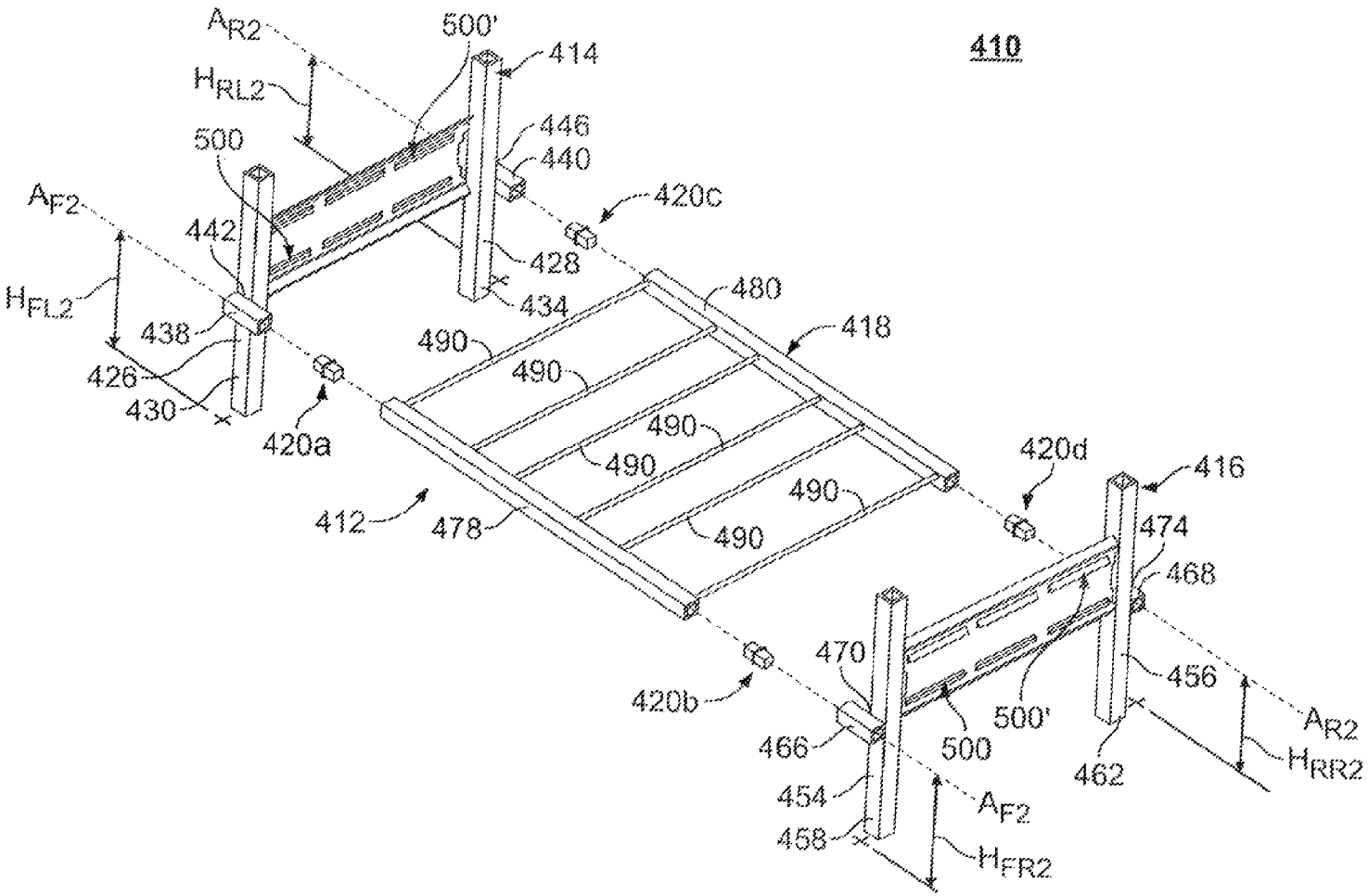
FIG. 9 is a horizontally-exploded perspective view showing a modular rack constructed in accordance with a second exemplary embodiment of the present invention, the modular rack including a single shelf of a level type.

Referring to FIG. 9, a modular rack 410 is shown and described in accordance with a second exemplary embodiment of the invention. Elements illustrated in FIG. 9 which correspond substantially to the elements described above with reference to FIG. 2 have been designated by corresponding reference numerals increased by four hundred. The embodiment of the present invention shown in FIG. 9 is constructed in manners consistent with the foregoing description of the modular rack 10 of FIG. 2, unless it is stated otherwise.

Referring to FIG. 9, the modular rack 410 includes a modular shelf 412 of the level type. The modular shelf 412 includes a left end subassembly 414, a right end subassembly 416, at least one middle subassembly 418, and a plurality of intra-shelf connectors 420*a-d* securing the middle subassembly 418 to the left end subassembly 414 and the right end subassembly 416.

The left end subassembly 414 includes a front left leg member 426 having a hollow bottom end, referenced herein as a front left base end 430, and a rear left leg member 428 having a hollow bottom end, referenced herein as a rear left base end 434. The left end subassembly 414 further includes a front left frame member 438 extending perpendicularly from the front left leg member 426 along a front axis $A_{F2}$, and a rear left frame member 440 extending perpendicularly from the rear left leg member 428 along a rear axis $A_{R2}$. A front left juncture point 442 is formed at the intersection of the front left leg member 426 and the front left frame member 438, and a rear left juncture point 446 is formed at the intersection of rear left leg member 428 and the rear left frame member 440.

The right end subassembly 416 includes a front right leg member 454 having a hollow bottom end, referenced herein as a front right base end 458, and a rear right leg member 456 having a hollow bottom end, referenced herein as a rear right base end 462. The right end subassembly 416 further includes a front right frame member 466 extending perpendicularly from the front right leg member 454 along the front axis $A_{F2}$, and a rear right frame member 474 extending perpendicularly from the rear right leg member 456 along the rear axis $A_{R2}$. A front right juncture point 470 is formed at the intersection of the front right leg member 454 and the front right frame member 466, and a rear right juncture point 474 is formed at the intersection of rear right leg member 456 and the rear right frame member 440.

As discussed above, the modular shelf 412 of FIG. 9 is of a level type for supporting BIB containers in a position that is substantially level with respect to ground-level. In this regard, the distance between the front left base end 430 and the front left juncture point 442, referenced herein as distance $H_{FL2}$, is substantially equal to the distance between the rear left base end 434 and the rear left juncture point 446, which is referenced herein as distance $H_{RL2}$. Moreover, the distance between the front right base end 458 and the front right juncture point 470, referenced herein as distance $H_{FR2}$, is substantially equal to the distance between the rear right base end 462 and the rear right juncture point 474, which is referenced herein as distance $H_{RR2}$. In other words, the distances $H_{FL2}$, $H_{RL2}$, $H_{FR2}$, $H_{RR2}$ are substantially equal to one another.

Continuing with reference to FIG. 9, the middle subassembly 418 includes a front middle frame member 478 extending along the front axis $A_{F2}$ and a rear middle frame member 480 extending along the rear axis $A_{R2}$. The elevation of the front middle frame member 478 is substantially equal to the elevation of the rear middle frame member 480. The middle subassembly 418 further includes a plurality of support members 490 securing the front middle frame member 478 to the rear middle frame member 480. The support members 490 extend level with respect to the ground and extend perpendicularly with respect to the front middle frame member 478 and the rear middle frame member 480. In contrast to the support bars 90 of FIG. 2, the modular shelf 412 does not include stopping means 94. Notwithstanding, it may be desirable for some embodiments of the modular shelf 412 to include stopping means, and in this regard, embodiments of the modular shelf 412 are not limited so as to necessarily exclude stopping means 94 therefrom. It shall be understood that the modular rack 10 can include any suitable combination of the modular shelf 12 of FIG. 2, the additional modular shelf 212 of FIGS. 7 and 8, and the modular shelf 412 of FIG. 9.

It will also be understood that the embodiments of the present invention described herein are merely exemplary and that a person skilled in the art may make many variations and modifications without departing from the spirit and the scope of the invention. All such variations and modifications, including those discussed above, are intended to be included within the scope of the invention as defined in the appended claims.

I claim:

1. In combination, a modular shelf assembly, comprising a first vertical support member, a second vertical support member, and a panel extending between said first and second vertical support members, wherein said panel is formed from a single piece of metal sheet, and wherein said panel has a first side and a second side opposite said first side, a first edge and a second edge opposing said first edge, an interior area having a first boundary spaced from said first edge and a second boundary spaced from said second edge, a first pair of louvers and a second pair of louvers located between said first and second boundaries of said panel, each of said pairs having a respective first louver and a respective second louver, said respective first louver extending obliquely from said first side of said panel and being opposed to and opening toward said respective second louver, and said respective second louver extending obliquely from said first side of said panel and being opposed to and opening toward said respective first louver, each of said louvers including a substantially rigid slat formed integrally with said metal sheet so as to provide a similarly shaped aperture in said metal sheet and a receiving area formed between said slat and said aperture, said receiving area having a triangular-shaped cross-section; a mounting bracket slidably and removably received between at least said first pair of louvers; and a peripheral device attached to said mounting bracket and extending outwardly therefrom such that said peripheral device is supported in a cantilevered fashion from said at least said first pair of louvers.

2. The combination of claim 1, wherein said substantially rigid slat is cut from said metal sheet.

3. The combination of claim 1, wherein said substantially rigid slat is punched from said metal sheet.

4. The combination of claim 1, wherein said modular shelf assembly includes a left end subassembly, said left end subassembly includes said first and second vertical support members; a right end subassembly, which includes third and fourth vertical support members; and a middle subassembly securable between said left end subassembly and said right end subassembly by a plurality of intra-shelf connectors.

5. The combination of claim 4, wherein said middle subassembly is angled with respect to ground.

6. The combination of claim 4, wherein said middle subassembly is level with respect to ground.

7. The combination of claim 4, wherein each one of said intra-shelf connectors includes a flange and a pair of male connection ends extending from opposite sides of said flange.

8. The combination of claim 4, wherein said peripheral device is a pump, and wherein said middle subassembly is sized and shaped to support a bag-in-box container thereon.

9. The combination of claim 1, further comprising another modular shelf assembly which is substantially identical to said modular shelf assembly, said substantially identical modular shelf assemblies being stackable one above the other.

10. The combination of claim 1, wherein said first and second vertical support members of said modular assembly are formed from metal.

11. The combination of claim 4, wherein each of said intra-shelf connectors is formed from plastic; and wherein said modular shelf assembly is formed from metal.

12. The combination of claim 1, wherein said panel has a first edge and a second edge opposing said first edge, said panel further comprising an interior area intermediate said first and second edges.

13. The combination of claim 1, wherein said panel has a first angled portion extending from said first boundary toward said first edge, and a second angled portion extending from said second boundary toward said second edge.

14. The combination of claim 1, wherein said interior area projects outwardly relative to said first and second edges of said panel.

15. The combination of claim 1, wherein said panel has a first end and a second end opposite said first end, each of said first and second ends extending between said first and second edges, said first pair of louvers being positioned proximate to said first end and said second pair of louvers being positioned proximate to said second end.

16. The combination of claim 1, wherein said substantially rigid slat is elongated.

17. The combination of claim 4, further comprising another panel extending between said third and fourth vertical support members.

18. The combination of claim 17, wherein said panels are identical to each other.

19. The combination of claim 18, wherein each of said panels includes a third pair of louvers.

20. The combination of claim 8, further comprising a bag-in-box container supported on said middle subassembly, said container being connected to said pump.

21. The combination of claim 7, wherein each of said subassemblies has a plurality of female connection ends, each of said female connection ends removably receiving one of said male connection ends of a corresponding one of said intra-shelf connectors.

22. In combination, a modular shelf assembly, comprising a left end subassembly which includes a first vertical support member, a second vertical support member, and a first panel extending between said first and second vertical support members, a right end subassembly which includes a third vertical support member, a fourth vertical support member, and a second panel extending between said third and fourth vertical support members, wherein at least one of said first and second panels is formed from a single piece of metal sheet, and wherein said at least one panel has a first side and a second side opposite said first side, a first pair of louvers and a second pair of louvers, each of said pairs having a respective first louver and a respective second louver, said respective first louver extending obliquely from said first side of said at least one panel and being opposed to and opening toward said respective second louver, and said respective second louver extending obliquely from said first side of said at least one panel and being opposed to and opening toward said respective first louver, each of said louvers including a substantially rigid slat formed integrally with said metal sheet so as to provide a similarly shaped aperture in said metal sheet and a receiving area formed between said slat and said aperture, said receiving area having a triangular-shaped cross-section, and a middle subassembly securable between said left end subassembly and said right end subassembly by a plurality of intra-shelf connectors; a mounting bracket slidably and removably received between at least said first pair of louvers; and a peripheral device attached to said mounting bracket and extending outwardly therefrom such that said peripheral device is supported in a cantilevered fashion from said at least said first pair of louvers.

23. The combination of claim 22, wherein said middle subassembly is angled with respect to the ground and sized and shaped to support a bag-in-box container thereon, and wherein said peripheral device is a pump.

24. The combination of claim 23, further comprising a bag-in-box container supported on said middle subassembly, said container being connected to said pump.

25. The combination of claim 22, wherein each one of said intra-shelf connectors including a flange and a pair of male connection ends extending from opposite sides of said flange.

26. The combination of claim 25, wherein each of said subassemblies has a plurality of female connection ends, each of said female connection ends removably receiving one of said male connection ends of a corresponding one of said intra-shelf connectors.

27. The combination of claim 22, wherein said at least one panel has a first edge and a second edge opposing said first edge, said at least one panel further comprising an interior area intermediate said first and second edges.

28. The combination of claim 22, wherein said at least one panel has a first edge and a second edge opposing said first edge, said at least one panel further comprising an interior area having a first boundary spaced from said first edge and a second boundary spaced from said second edge, said first and second pairs of louvers being located between said first and second boundaries.

29. The combination of claim 28, wherein said at least one panel has a first angled portion extending from said first boundary toward said first edge, and a second angled portion extending from said second boundary toward said second edge.

30. The combination of claim 28, wherein said interior area projects outwardly relative to said first and second edges of said at least one panel.

31. The combination of claim 28, wherein said at least one panel has a first end and a second end opposite said first end, each of said first and second ends extending between said first and second edges, said first pair of louvers being positioned proximate to said first end and said second pair of louvers being positioned proximate to said second end.

32. The combination of claim 22, wherein said slat is elongated.

33. The combination of claim 22, wherein said panels are identical to each other.

34. The combination of claim 33, wherein each of said panels includes a third pair of louvers.

35. In combination, a modular shelf assembly, comprising a left end subassembly which includes a first vertical support member, a second vertical support member, and a first panel extending between said first and second vertical support members, a right end subassembly which includes a third vertical support member, a fourth vertical support member, and a second panel extending between said third and fourth vertical support members, a middle subassembly extending between and connected to said left end subassembly and said right end subassembly, and an upper support subassembly which includes a fifth vertical support member projecting upwardly from and supported by said left end subassembly, a sixth vertical support member projecting upwardly from and supported by said right end subassembly, and a third panel extending between said fifth and sixth vertical support members, wherein at least one of said first, second and third panels is formed from a single piece of metal sheet, and wherein said at least one panel has a first side and a second side opposite said first side, a first pair of louvers and a second pair of louvers, each of said pairs having a respective first louver and a respective second louver, said respective first louver extending obliquely from said first side of said at least one panel and being opposed to and opening toward said respective second louver, and said respective second louver extending obliquely from said first side of said at least one panel and being opposed to and opening toward said respective first louver, each of said louvers including a substantially rigid slat formed integrally with said metal sheet so as to provide a similarly shaped aperture in said metal sheet and a receiving area formed between said slat and said aperture, said receiving area having a triangular-shaped cross-section; a mounting bracket slidably and removably received between at least said first pair of louvers; and a peripheral device attached to said mounting bracket and extending outwardly therefrom such that said peripheral device is supported in a cantilevered fashion from said at least said first pair of louvers.

36. The combination of claim 35, wherein said middle subassembly is angled with respect to the ground and said peripheral device is a pump, and wherein said middle subassembly is sized and shaped to support a bag-in-box container thereon.

37. The combination of claim 36, further comprising a bag-in-box container supported on said middle subassembly, said container being connected to said pump.

38. The combination of claim 35, wherein said left end subassembly, said right end subassembly, said middle subassembly, and said upper support subassembly are connected to each other by a plurality of intra-shelf connectors, each one of said intra-shelf connectors including a flange and a pair of male connection ends extending from opposite sides of said flange.

39. The combination of claim 38, wherein each of said subassemblies has a plurality of female connection ends, each of said female connection ends removably receiving one of said male connection ends of a corresponding one of said intra-shelf connectors.

40. The combination of claim 35, wherein said at least one panel has a first edge and a second edge opposing said first edge, said at least one panel further comprising an interior area intermediate said first and second edges.

41. The combination of claim 35, wherein said at least one panel has a first edge and a second edge opposing said first edge, said panel further comprising an interior area having a first boundary spaced from said first edge and a second boundary spaced from said second edge, said first and second pairs of louvers being located between said first and second boundaries.

42. The combination of claim 41, wherein said at least one panel has a first angled portion extending from said first boundary toward said first edge, and a second angled portion extending from said second boundary toward said second edge.

43. The combination of claim 41, wherein said at least one interior area projects outwardly relative to said first and second edges of said panel.

44. The combination of claim 41, wherein said at least one panel has a first end and a second end opposite said first end, each of said first and second ends extending between said first and second edges, said first pair of louvers being positioned proximate to said first end and said second pair of louvers being positioned proximate to said second end.

45. The combination of claim 35, wherein said slat is elongated.

* * * * *